United States Patent [19]

Theurer et al.

[11] Patent Number: 4,983,801

[45] Date of Patent: Jan. 8, 1991

[54] RAIL TENSIONING APPARATUS

[75] Inventors: Josef Theurer, Vienna; Johann Hansmann, deceased, late of Klosterneuburg, by Gisela Hansmann, heir; Friedrich Oellerer, Linz; Leopold R. Gruber, Scheibbs, all of Austria

[73] Assignee: Franz Plasser Bahnbaumaschinen-Industriegesellschaft m.b.H., Vienna, Austria

[21] Appl. No.: 301,186

[22] Filed: Jan. 24, 1989

[30] Foreign Application Priority Data

Feb. 1, 1988 [AT] Austria ..... 198/88

[51] Int. Cl.[5] ..... B23K 11/04

[52] U.S. Cl. ..... 219/54; 219/97

[58] Field of Search ..... 219/53, 54, 55, 97, 219/100

[56] References Cited

U.S. PATENT DOCUMENTS 3,349,216 10/1967 Paton et al. .
4,272,664 6/1981 Theurer .

FOREIGN PATENT DOCUMENTS 132227 1/1985 European Pat. Off. .
1161307 8/1969 United Kingdom .
1294216 10/1972 United Kingdom .
2000829 1/1979 United Kingdom .
2183275 6/1987 United Kingdom .

OTHER PUBLICATIONS

Plasser & Theurer prospectus K 355 APT, Feb. 86.

*Primary Examiner*—Clifford C. Shaw
*Attorney, Agent, or Firm*—Kurt Kelman

[57] ABSTRACT

An apparatus for tensioning or longitudinally sliding a rail of a laid track to reduce a gap between adjacent ends of longitudinally successive rail sections to be welded together to form the rail, the fastening elements of the longitudinally successive rail sections having been loosened, which comprises a closed, ring-shaped mechanical structural unit including two longitudinally spaced pairs of rail clamping jaws and two transversely spaced hydraulic cylinder-piston devices connecting the pairs of rail clamping jaws and operating the same. These pairs of rail clamping jaws are spaced longitudinally and the cylinder-piston devices are spaced transversely to define a sufficient central space in the ring-shaped mechanical structural unit for receiving a flash-butt welding head.

26 Claims, 3 Drawing Sheets

Fig.10
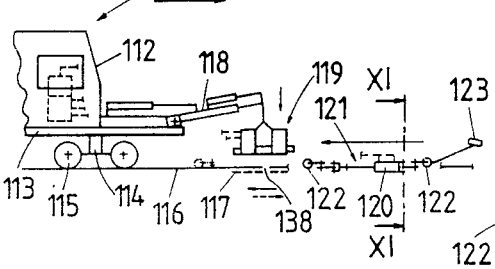
Fig.11
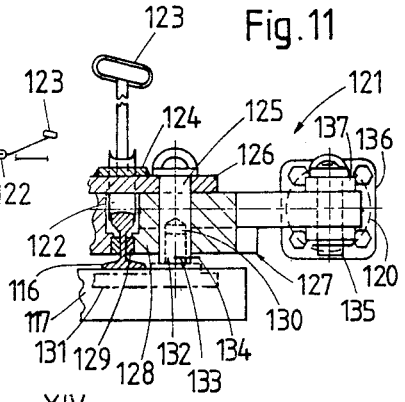
Fig.12
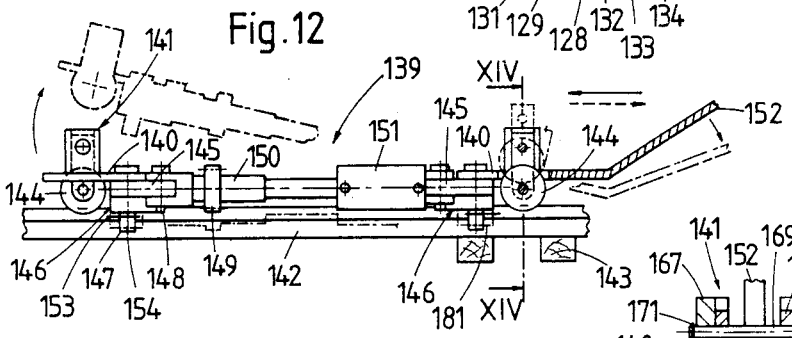
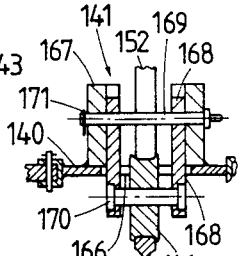
Fig.14
Fig.13
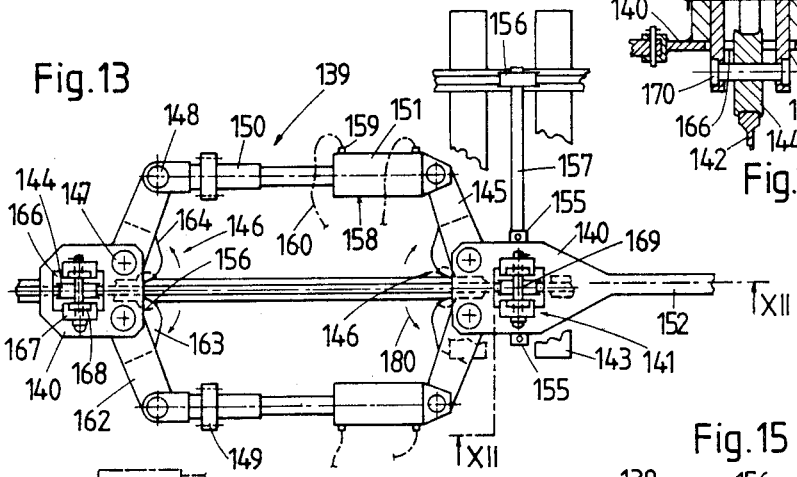
Fig.15
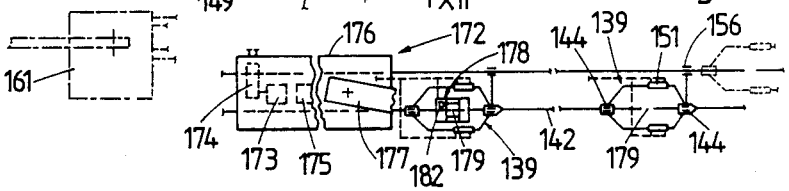

RAIL TENSIONING APPARATUS

BACKGROUND OF THE INVENTION (1) Field of the Invention

The present invention relates to improvements in an apparatus for tensioning or longitudinally sliding a rail of a laid track consisting of two rails fastened to ties by fastening elements to reduce a gap between adjacent ends of longitudinally successive rail sections to be welded together to form the rail, the fastening elements of the longitudinally successive rail sections having been loosened, which comprises a closed, ring-shaped mechanical structural unit including two longitudinally spaced pairs of rail clamping jaw means and two transversely spaced hydraulic cylinder-piston devices for operating the rail clamping jaw means, each device connecting respective rail clamping jaw means of said pairs.

(2) Description of the Prior Art

Such a rail tensioning apparatus has been used in preparing for the welding of the adjacent ends of longitudinally successive rail sections to form a welded rail, particularly in the welding process with a mobile flash-butt welding machine, as disclosed in the Plasser & Theurer prospectus entitled K355 APT, of February 1986.

The flash-butt welding heads in these machines exert a sufficient tensioning force on the rail sections to enable short rail sections to be welded together or to weld together longer rail sections if they are supported on rollers to reduce frictional resistance to a minimum. In end welds, the rails are lifted out of their fastening elements, and changes in the rail length due to welding are compensated for by inserting corresponding lengths of rail section. However, a relatively large tensioning force is required to provide flash-butt welded joints between longer rail sections, particularly when they are not supported on anti-friction rollers, in cases where so-called thermite weld joints are cut out, resulting in large welding gaps which must be replaced by flash-butt welded joints, as well as for end welds at temperatures below the normal welding temperature and continuous welded track rails.

U.S. Pat. No. 3,349,216, dated Oct. 24, 1967, discloses an electrically operated flash-butt welding head useful in rail welding operations, which comprises two welding halves displaceable with respect to each other and designed to clamp the adjoining rail sections and pull them together. The rail clamps constitute welding elements and have a common rotary axis wherealong they are displaceable by means of hydraulically operated cylinders. The piston rods of the operating cylinders connect the clamps and are arranged symmetrically with respect to the weld and are coplanar therewith. The rotary axis is constituted by a hollow rod containing a control valve for uniformly delivering hydraulic fluid to the operating cylinders and the control valve is actuated by an electromagnetic drive mounted on the rod.

British patent No. 1,294,216, published Oct. 25, 1972, discloses a hydraulic tensioning device for continuous welded rail, which is constituted by a ring-shaped structural unit comprising two longitudinally spaced pairs of rail clamping heads interconnected by tie members extending above and below the rail for rotation about a vertical axis. Short bell-crank levers connect the clamping jaws respectively with hydraulic cylinders and tensioning members extending in the direction of the rail and parallel to a horizontal plane passing through the rail. A manually operated pump delivers hydraulic fluid to the cylinders and when they are operated, the clamping jaws clampingly engage the rail web and, upon additional hydraulic pressure being applied, the clamped ends of the two adjoining rail sections, whose fastening elements have previously been loosened, are pulled together to reduce the gap between the adjacent rail section ends and enable them to be welded together. This device is relatively heavy and may be disassembled. The device is mounted on the rail sections at each welding site, dismounted after use and transported to the next site where it is mounted again and operated by the manually operated hydraulic fluid pump. To enable the device to be readily transported from welding site to welding site, it has been made as small and light as feasible, thus limiting the dimensions of the central space within the ring-shaped unit. Even so, the unit may weigh as much as about 400 kg and is, therefore, difficult to handle, which considerably delays the operations.

A similar, but much lighter and even smaller, rail tensioning device has been disclosed in British patent No. 1,161,307, published Aug. 13, 1969. This device has such small dimensions that its tensioning force suffices only for longitudinally sliding or stretching very short and light rail sections.

Another rail tensioning apparatus of this general type has been disclosed in British patent No. 2,183,275, published June 3, 1987. The apparatus comprises two longitudinally spaced pairs of rail clamping jaws respectively operated by hydraulic cylinder-piston devices arranged at each side of the rail. Each pair of rail clamping jaws comprises two bell-crank lever clamping jaws arranged mirror-symmetrically with respect to a vertical plane passing through the rail and arranged in the same horizontal plane. Pivot axles link the lever clamping jaws to detachable holding members which interconnect the clamping jaws, the two longer lever arms of one of the clamping jaws of each pair being linked directly to the two operating cylinders and the two longer lever arms of the other clamping jaws of each pair being linked directly to the relatively long piston rods of the cylinders. The four shorter lever arms have arcuate clamping jaws for engaging the rail web. This apparatus, too, is manually transported from welding site to welding site and must, therefore, be relatively small and light. It is used to provide a mechanical connection between rail section ends by means of insulated fish plates. The width of the apparatus transversely to the rail is quite small, the spacing between the piston rods being the same, or only a little greater, than the mechanical connection itself.

European patent No. 132,227, published Jan. 23, 1985, discloses a ring-shaped rail tensioning unit for use in welding together the adjacent ends of rail sections. This unit is designed for longitudinally, vertically and laterally displacing a respective rail section end for centering the same with respect to an adjacent rail section end before the ends are welded together. It is a rather complicated device including a number of servomechanisms and provides a central space holding a shearing device with cutters for removing the weld seam. As the drawing clearly shows, this space is much too narrow to hold a flash-butt welding head.

The welding machine disclosed in U.S. Pat. No. 4,272,664, dated June 9, 1981, provides a hydraulic support shoe for the machine frame to relieve the track rails of the machine weight before the welding. The thus relieved rail may then be slid more readily to reduce the welding gap.

SUMMARY OF THE INVENTION

It is the primary object of this invention to provide a rail tensioning apparatus of the first-described type which may be used under a great variety of operating conditions and may also provide greater tensioning forces for longitudinally sliding rail sections clamped thereto.

In such an apparatus, the invention accomplishes this and other objects with the pairs of rail clamping jaw means being spaced longitudinally and the cylinder-piston devices being spaced transversely to define a sufficient central space within the ring-shaped mechanical structural unit for receiving a flash-butt welding head.

This construction of the apparatus enables it to be used not only by itself, for example for longitudinally sliding or pulling long rails or for reducing gaps formed by cutting out thermite welded rail joints, but also very effectively in conjunction with a flash-butt welding head. Since the welding head is totally encompassed by the ring-shaped rail tensioning unit, the rail tensioning and welding proceed smoothly. Since the welding head and the rail tensioning apparatus can be operated in synchronization, the tensioning and compression force for the flash-butt welding, particularly at the final compression impact, may be substantially increased. Furthermore, this apparatus has the advantage that it requires no time-consuming or labor-intensive restructuring for its use either alone or in combination with the welding head.

DESCRIPTION OF THE DRAWING

The above and other objects, advantages and features of the present invention will become more apparent from the following detailed description of certain now preferred embodiments thereof, taken in conjunction with the partly diagrammatic drawing wherein

FIG. 10 schematically shows a further type of an electric flash-butt welding machine with a jib crane carrying the welding head and the rail tensioning unit encompassing the welding head;

FIG. 11 is an enlarged cross section along line XI—XI of FIG. 10, showing a portion of the rail tensioning unit;

FIG. 12 is a side elevational view of another embodiment of the rail tensioning unit with double-flanged wheels supporting the apparatus at its two ends on the rail;

FIG. 13 is a top view of FIG. 12;

FIG. 14 is an enlarged cross section along line XIV—XIV of FIG. 12, showing the mounting of one of the double-flanged wheels; and FIG. 15 is a schematic and highly simplified top view of a welding machine with a jib crane for the flash-butt welding head and the rail tensioning unit arranged independently thereof and ahead of the welding head.

DETAILED DESCRIPTION OF THE PREFERRED EMBODIMENTS

Figure 1:
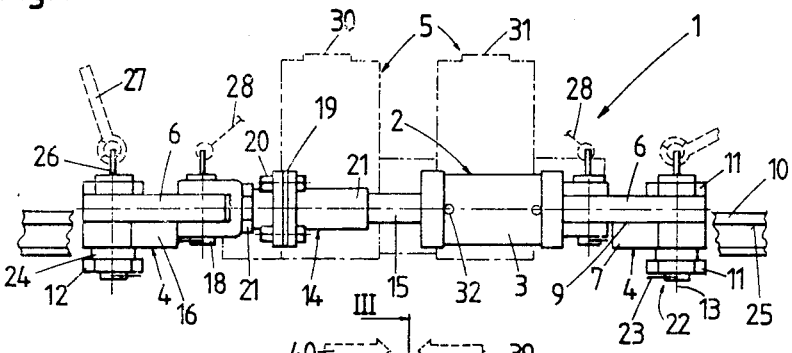
FIG. 1 is a side elevational view of a rail tensioning apparatus for longitudinally sliding a rail of a laid track, showing the apparatus in its operating position and indicating a flash-butt welding head received within its central space in chain-dotted lines.
Figure 2:
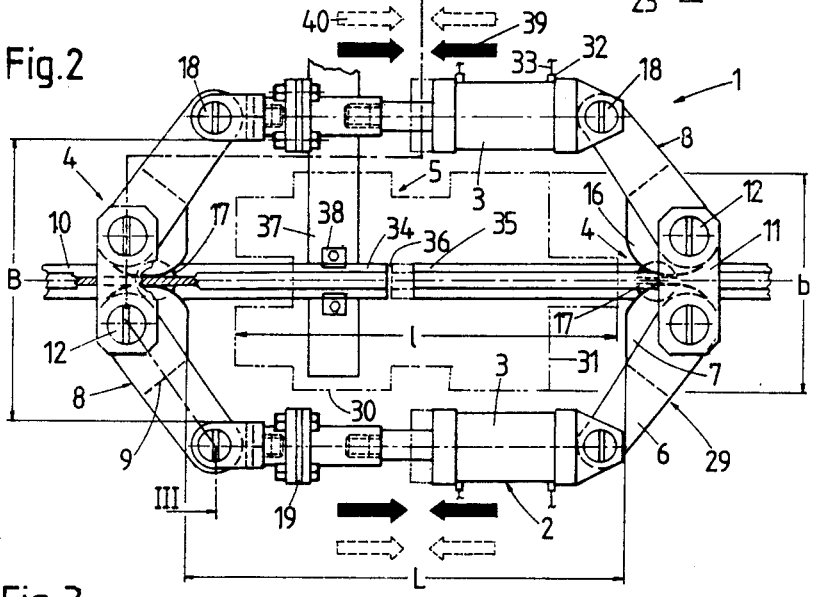
FIG. 2 is a top view of the apparatus of FIG. 1.
Figure 3:
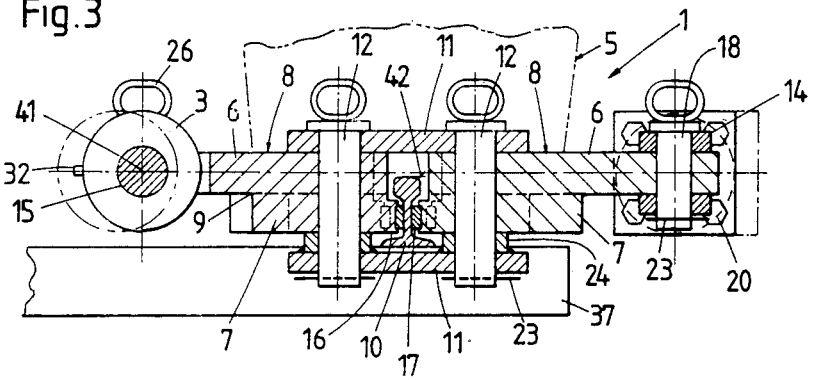
FIG. 3 is an enlarged cross section along line III—III of FIG. 2.

Referring now to the drawing and first to FIGS. 1 to 3, there is shown apparatus 1 for tensioning or longitudinally sliding rail 10 of a laid track consisting of two rails fastened to ties 37 by fastening elements 38 to reduce gap 36 between adjacent ends 34, 35 of longitudinally successive rail sections to be welded together to form the rail, the fastening elements of the longitudinally successive rail sections having been loosened to permit the longitudinal sliding or tensioning. This apparatus comprises, as clearly shown in FIG. 2, a closed, ring-shaped mechanical structural unit including two longitudinally spaced pairs 4 of rail clamping jaw means and two transversely spaced hydraulic cylinder-piston devices 2 with operating cylinders 3 for operating the rail clamping jaw means. Each device 2 connects respective rail clamping jaw means of pairs 4, and the pairs of rail clamping jaw means are spaced longitudinally and cylinder-piston devices 2 are spaced transversely to define a sufficient central space within the ring-shaped mechanical structural unit for receiving electric flash-butt welding head 5.

As shown in FIG. 2, a respective hydraulic cylinder-piston device 2 is arranged on each side of rail 10 and flash-butt welding head 5 comprises two halves 30, 31 longitudinally adjustable with respect to each other. The central space, measured in a horizontal plane passing through the rail, has a width D and length L at a maximum longitudinal spacing of pairs 4 of rail clamping jaw means in a rail clamping position respectively larger than width b and the length 1 of the cross section of the maximally adjusted welding head halves so that the circumference of the welding head is always within the bounds of the central space. Preferably, the width and length of the central space are about 10–15% larger than the width and length of the cross section of the maximally adjusted welding head. This dimensioning of the ring-shaped rail tensioning unit enables the welding head always to be centered within the free central space rapidly and without any problems. At the same time, it also permits the independent use and operation of the rail tensioning unit and the welding head while making the manufacture of the apparatus simple and cost-effective.

As shown, electrical insulation 19 is provided between the longitudinally spaced pairs 4 of rail clamping jaw means at each side of rail 10 for interrupting any flow of electric current between the pairs of rail clamping jaw means. This insulation enables the rail tensioning unit to be used with an electrically operated flash-butt welding head without the danger of short circuits between the pairs of rail clamping jaw means, which would interfere with the welding process.

As best shown in FIG. 3, each pair 4 of rail clamping jaw means comprises two double levers 8 arranged mirror-symmetrically with respect to a vertical plane passing through rail 10, each double lever consisting of short lever arm 7 and superposed long lever arm 6, the short and long lever arms 6, 7 defining step 9 therebetween. The short and the long lever arms are preferably manufactured separately and the short lever arm is welded to the underside of the long arm. It operates eccentrically in the manner of a bell-crank lever. It constitutes a rail clamping jaw, having arcuate jaw 16 and carrying intermediate clamping member 17 of substantially semi-circular cross section. Each pair of rail clamping jaw means further comprises two detachable holding members 11 spanning rail 10 respectively thereabove and therebelow and arranged to connect and to hold transversely aligned double levers 8 therebetween, and respective pivot axis 13 pivotally connects each double lever to the holding members at each side of the rail. Long lever arms 6 of one of pairs 4 of rail clamping jaw means are linked directly to cylinders 3 of cylinder-piston devices 2, and the ring-shaped structural unit further comprises intermediate extension members 14 linking the long lever arms 6 of the other pair of rail clamping jaw means to the pistons of the cylinder-piston devices by means of piston rods 15. Long lever arms 6 are connected to cylinders 3 and extension members 14, respectively, by plug-in bolts 18.

The simple, yet robust construction of the rail tensioning unit with a double lever consisting of a short and a long arm, particularly in combination with the extra width of the ring-shaped unit enabling a welding head to be received within it makes it possible to space the two operating cylinders a considerable distance from each other. This also enhances the lever effect and correspondingly increases the clamping force of the pairs of rail clamping jaws so that high tensile forces may be transmitted to the rail, enabling even long welded rail sections to be pulled.

In this structure, electrical insulation 19 at each side of rail 10 is arranged between two coaxial interconnected parts 21 of intermediate extension member 14 to interrupt the flow of electrical current between pairs 4 of the rail clamping jaw means. The two coaxial extension member parts are connected by threaded fasteners 20. This construction assures not only safe electrical insulation but also a secure transmission even of very high tensile or compression forces.

As shown in FIG. 3, lower holding member 11 has spacing elements 24 attached thereto, for example by welding, the spacing elements extending between clamping jaws 16 of double levers 8 and the lower holding member. Pivot axes 12 are constituted by detachable plug-in bolts 12 inserted into registering bores in the holding members and double levers to interconnect the transversely aligned double levers of each pair 4 of rail clamping jaw means. Detachable retaining means 22 at the lower ends of bolts 12 hold the assembly in position, the illustrated retaining means being a splint pin means 23, such as a cotter pin, inserted in the lower ends of bolts 12 below lower holding member 11 for rapid detachment and retention of the bolt. Clamping double levers 8 between two holding members will enable the structure to transmit very high tensile and compression forces while the detachable mounting of the lower holding member makes it possible rapidly and readily to remove this holding member to enable the rail section ends to be inserted between the double levers of each pair of clamping jaws without any problem. The lower holding member may be readily detached before the rail tensioning apparatus is placed in its operating position and it may be quickly attached again to the plug-in bolts between two ties and retained in position.

The long lever arms 6 extend in a horizontal plane in the range of the rail head of rail 10 and have an upper side extending thereabove. Short lever arms 7 extend in a horizontal plane in the range of the rail web connecting underside 25 of the rail head with the rail base and have an underside extending above the rail base. The short lever arms have about half the length of the long lever arms. This particular stepped structure of double levers 8 enables a larger distance of operating cylinders 3 from the upper side of the ties in their working position while still preserving the robust lever mechanism designed to transmit very high forces. This makes it possible to use operating cylinders with larger diameters, which increases their operating power.

Plug-in bolts 12 and 18 have shackles or eyes 26 for attaching suspension means 27, 28 (shown in broken lines in FIG. 1) to ring-shaped rail tensioning unit 29. In this manner, the unit may be stored on a machine when it is moved between operating sites.

Flexible hydraulic fluid hoses 33 connect inlets and outlets 33 in cylinders 3 of cylinder-piston devices 2 to suitable hydraulic fluid supply pump means for operating the rail clamping jaw means. The hydraulic fluid supply pump means may be a manually operated pump or a hydraulic pump on a mobile welding machine. This enables the apparatus to be used independently by connecting it to a manually operated pump or in conjunction with a welding machine.

Before a rail section is tensioned to reduce gap 36, fastening elements 38 of respective rail section end 34 or 35 are loosened to enable its rail base to slide longitudinally with respect to tie 37. Arrows 39 and 40 indicate the respective sliding directions of the rail section ends.

The distance between plug-in bolts 12 and 18 along long lever arm 6 is at least 2.5 times the distance between plug-in bolt 12 and the surface of intermediate clamping member 17 on short arm 7 which engages the rail web. In the specific embodiment illustrated in FIG. 2, this distance is three times that between bolt 12 and this rail web engaging surface.

Axes 41 of operating cylinders 3 and intermediate extension members 14 linked to the long arms 6 are arranged just above horizontal plane 42 defined by an upper side of the rail head. This enables the parts of unit 29 cooperating with the pairs of rail clamping jaws, and particularly the long lever arms, to be dimensioned with an increased cross section whereby the structure is made very robust and capable of absorbing high stresses.

The position of cylinder 3 and extension member 14 when double lever 8 is outwardly pivoted is shown in chain-dotted lines in FIG. 3, clamping jaw 16 and intermediate clamping member 17 being spaced from the rail web in this inoperative position.

Figure 4:
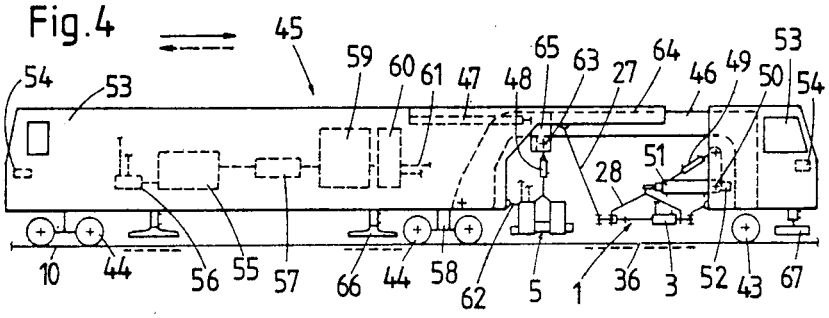
FIG. 4 is a schematic side elevation of an electric flash-butt welding machine incorporating the welding head and the rail tensioning apparatus of this invention.

In the embodiment of FIG. 4, mobile rail welding machine 45 is supported on the track rails by longitudinally spaced undercarriages 43, 44, the rail welding machine including bridge-like machine frame 46. Flash butt-welding head 5 and ring-shaped structural rail tensioning unit 1 are longitudinally, transversely and vertically adjustably arranged between two of the longitudinally spaced undercarriages. In the illustrated embodiment, the mobile welding machine includes trailer 69 supported on one of the undercarriages 43 and the bridge-like machine frame part extends between the machine and the trailer. For the adjustment of unit 1, machine frame 46 is provided with transverse guide 50 pivotally supporting telescopingly extensible support arm 51 operated by power drive 49 for raising and lowering the arm, and suspension 28 suspending the unit from the support arm. Support arm 51 is transversely adjusted in guide 50 by power drive 52. This arrangement of the rail tensioning unit on a rail welding machine enables this unit to be used in conjunction with the welding head to increase the tension force, if this is desirable, or to use the welding head and the rail tensioning unit separately. The independent mounting of the rail tensioning unit and the welding head make it possible to operate and position the same separately.

Machine 45 has an operator's cab 53 at each end and each cab is equipped with control panel 54. Motor 55 drives hydraulic fluid pump 56 as well as electric generator 57 and drive 58 for propelling the machine along the track. Control station 59 houses control 60 for operating welding head 5, the control being connected to the welding head by electrical conductor lines 61. In this manner, the operation of the rail clamping jaw means and of the welding head may be synchronized for simultaneously reducing gap 36 between the adjacent rail section ends and for welding the adjacent rail section ends together. This assures a simple and rational operation of the machine and the control enables a synchronized cooperation of the rail tensioning and welding stages.

Rod 62 detachably connects welding head 5 to welding machine 45 to hold the welding head stationary on the machine when the same is moved between operating sites. Suspension 65 for welding head 5 is mounted for displacement in transverse guide 63 and longitudinal guide 64 of bridge-like frame 46 to enable the welding head to be transversely and longitudinally adjusted. The undercarriages 44 are double-axled swivel trucks, and undercarriage 43 supporting the trailer is single-axled. Vertically adjustable support jacks 66, 67 are mounted respectively between swivel trucks 44 and immediately adjacent single-axled undercarriage 43.

Figure 6:
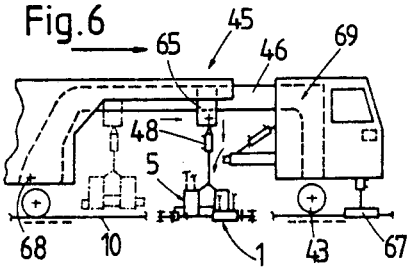
FIG. 6 is a partial side elevational view of the welding machine of FIG. 4, the welding head and the rail tensioning unit being in the operating position.
Figure 5:
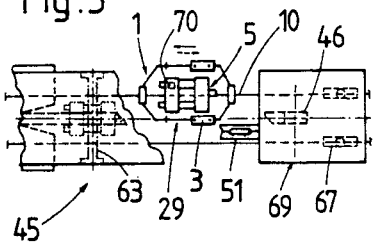
FIG. 5 is a partial top view of the welding machine of FIG. 4, the welding head being arranged in the operating position within the ring-shaped rail tensioning unit.

FIG. 5 shows rail tensioning unit 29 of apparatus 1 and welding head 5 in their operating positions, the welding head being arranged within the ring-shaped structural unit for the simultaneous tensioning of the rail and welding of a joint between the abutting rail section ends. As illustrated in FIG. 6, forward support jack 67 is lowered before the tensioning and welding operations are started so that undercarriage 43 is lifted slightly off rail 10 as the trailer is upwardly pushed by its support jack, the trailer being linked to welding machine 45 by pivot joint 68. While apparatus 1 is detached from suspension 28 in its operating position, vertical adjustment drive 48 continues to attach welding head 5 to suspension 65 so that the welding head remains connected to machine frame 46.

The operation of rail tensioning apparatus 1 and its possible cooperation with welding head 5 will be partially apparent from the above description of their structure and will be described in detail hereinbelow with reference to FIGS. 1 to 6, the structure and operation of a useful welding head being described in detail in the above-mentioned Plasser & Theurer prospectus and U.S. Pat. No. 3,349,216.

In the position of rail tensioning apparatus 1 and welding head 5, welding machine 45 is moved along the track in either operating direction indicated by the two oppositely pointing arrows to the operating site. Upon arrival thereat, suspension rod 27 is detached from suspension 28 to enable apparatus 1 to assume its lowered operating position on rail 10 centered with respect to gap 36, the proper positioning being effected by operation of drives 49 and 52 suitably displacing support arm 51, and the two lower holding members 11 are removed after detaching retaining means 23 from the four plug-in bolts 12. Rod 62 is detached from the welding head to enable it to be longitudinally displaced and to be lowered into the central space defined by ring-shaped rail tensioning unit 29. Rail 10 is inserted between the plug-in bolts so that the rail web extends between clamping jaws 16 of the two pairs 4 of the rail clamping jaw means. Rail tensioning apparatus is so displaced longitudinally by telescopingly extensible support arm 51 that the lower ends of bolts 12 project downwardly between two successive ties 37. Thereupon, the lower holding members are again attached to the bolts and retained in position by insertion of splint pins 22. Operating cylinders 3 are then actuated just enough to enable intermediate clamping members 17 of clamping jaws 16 to contact the rail web therebetween. Meanwhile, welding head 5 may be longitudinally and transversely adjusted and lowered by drive 48 to engage rail section ends 34, 35 in the range of gap 36. Jack 67 is lowered until its foot engages an underlying tie 37 so that trailer 69 is lifted slightly off rail 10.

Synchronizing control 70 on welding head 5, which is connected to control 60 on welding machine 45, now initiates the common rail tensioning effected by unit 29 and two-part welding head 5, as operating cylinders 3 move the pairs of rail clamps holding the rail section ends therebetween towards each other and the two parts of the welding head are moved together. In the embodiment shown in FIGS. 4 and 5, the right rail section end 35 is relieved of weight and its fastening elements are loosened so that it may be longitudinally slid in the direction of arrow 39 (FIG. 2) towards the stationary left rail section end 34 to narrow gap 36 therebetween. As soon as this gap has reached its desired dimension, which is about 14 mm for flash-butt welding, the controls automatically initiate the welding process. After the two rail section ends have been welded together, the ends are pulled together under very high pressure in a so-called upset welding stroke by the combined operation of rail tensioning apparatus 1 and two-part welding head 5, which produces a welding seam. This seam is subsequently removed by a metal shearing device incorporated in the welding head. Subsequently, drive 48 is actuated to lift welding head 5 off the track while lower holding members 11 are removed after detaching retaining pins 23. Apparatus 1 is then lifted off rail 10 by means of suspension 28 and support arm 51, and jacks 66 and 67 are retracted, as shown in FIG. 4, whereupon machine 45 is moved to next rail gap 36.

Figure 7:
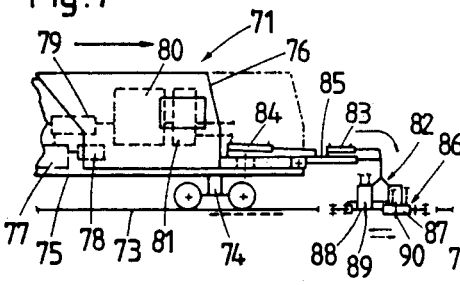
FIG. 7 schematically shows another type of an electric flash-butt welding machine with a jib crane carrying the welding head and the rail tensioning unit encompassing the welding head and connected therewith by a suspension yoke.
Figure 8:
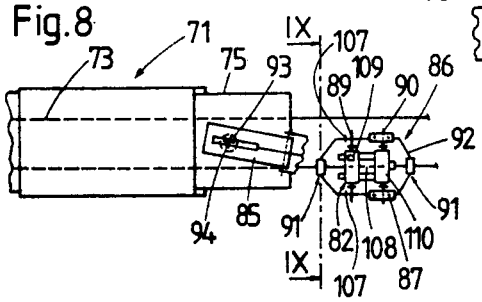
FIG. 8 is a top view of the machine of FIG. 7.

FIGS. 7 and 8 show the front end of a mobile rail welding machine 71 supported on a track consisting of rails 73 fastened to ties 72, wherealong the machine may be propelled by drive 74. Operator's cab 76 is longitudinally displaceably carried by machine frame 75 so that the cab may be displaced between an advanced operating position shown in full lines and a retracted position shown in chain-dotted lines, which is assumed when the machine is moved between operating sites. Machine frame 75 also carries motor 77 driving a hydraulic fluid pump 78 and an electrical generator 79. Control station 80 and flash-butt welding control 81 are connected to the electrical generator. The hydraulic fluid pump as well as the control are connected to welding head 82. Telescopingly extensible cantilever or jib crane 85 mounts the welding head for longitudinal, transverse and vertical adjustment thereof on the front end of the machine for placing welding head 82 within the central space of ring-shaped rail tensioning unit 86, which includes operating cylinders 87 and intermediate extension members 88. The welding head and structural unit 86 are centered with respect to each other by means of suspension yokes 89, 90.

As shown in FIG. 8, the rail tensioning unit is of the type fully described hereinabove in connection with FIGS. 1 to 3 and comprises two longitudinally spaced pairs 91 of rail clamping jaw means each comprising two double levers 92 operated by cylinders 87, on the one hand, and connected to intermediate extension members 88, on the other hand. Cantilever crane 85 may be pivoted on machine frame 75 about vertical axis 94 by means of drive 93.

Figure 9:
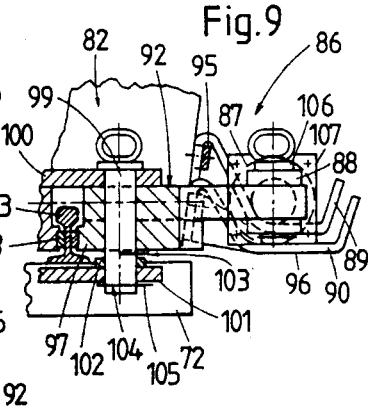
FIG. 9 is an enlarged cross section along line IX—IX of FIG. 8, showing a portion of the rail tensioning unit.

As shown in the fragmentary view of FIG. 9, suspension yokes 89, 90 for positioning rail tensioning apparatus 86 are inserted in brackets 95 connected to welding head 82. The substantially U-shaped suspension yokes have horizontally extending base legs 96 which are a little wider than operating cylinders 87 and extension members 88 of apparatus 86, which they support. Each double lever 92 provided with clamping jaw 97 and intermediate clamping member 98 is pivotal about plug-in bolt 99. Two transversely aligned double levers form a pair held together by upper and lower holding members 100, 101. The lower holding member has a spacing element 102 facing each double lever. The plug-in bolt is held in position by detachable retaining means 104 below lower holding member 101 and another detachable retaining means 103 inserted in the bolt between the double lever and spacing element 102. The illustrated retaining means are splint or cotter pins 105. Plug-in bolts 106 link double levers 92 respectively to operating cylinders 87 and intermediate extension members 88. Electrical insulations 107 are arranged between the operating cylinder and the extension member at each side of the rail.

The welding machine illustrated in FIGS. 7 to 9 has a very simple structure and has the advantage that a commercially well established mobile rail welding machine may be retrofitted without any other structural changes to incorporate the special rail tensioning unit therein. The suspension yoke supporting the welding head can be used to place the welding head and the rail tensioning unit into their operating position. The suspension yoke is sufficiently wide so that the operating cylinders and the tension members associated therewith leave a suitable longitudinal and transverse clearance for the pivoting of the double levers.

This machine for the combined tensioning and welding of rails operates in a manner similar to that described hereinabove in connection with FIGS. 1 to 6 and will be now described in more detail.

As soon as machine 71 has been moved along the track in an operating direction shown by the arrow in FIG. 7 to reach its operating site adjacent gap 108 (FIG. 8) between two rail section ends, the front of operator's cab 76 is opened and the cab is retracted into the position shown in full lines in FIG. 7. Welding head 82 and rail tensioning unit 86 carried thereon within cab 76 during the time the machine is moved between operating sites are then moved forwardly by actuation of drives 83, 84. Drive 93 is then actuated to swing cantilever crane 85 (see FIG. 8) so that the welding head with the rail tensioning unit carried thereon by means of yokes 89, 90 is aligned with right rail 73 and centered over gap 108. Welding head 82 and unit 86 are then lowered onto right rail 73, with transversely aligned plug-in bolts 99 of the two pairs of rail clamping jaw means being positioned between two adjacent ties 72. After the two rail sections ends have been inserted between the plug-in bolts 99 of each pair and clamping jaws 97 are in a position for engagement with the rail web, lower holding members 101 are attached to the bolts and secured in position by insertion of retaining means 105.

Synchronizing control 109 on welding head 82, which is connected to welding control 81, is now operated to actuate cylinders 87 and pivot double levers 92 into clamping engagement with the rail web. At the same time, the welding and clamping jaw pairs on the two halves 110 of the welding head are also pressed against the rail web. During the subsequent welding together of the two rail section ends, they are pulled together and in a final upset welding stroke powerfully pressed against each other by the combined operation of cylinders 87 of rail tensioning unit 86 and of the hydraulic cylinders of the welding head which cause the welding head halves to move towards each other. After the welding process has been completed and the weld seam has been sheared off, lower holding members 101 are removed again to enable the cantilever or jib crane to lift the welding head with the rail tensioning unit. Retaining means 103 remains in place and prevents sliding of double levers 92 off bolts 99. The machine is now ready to be driven to the next rail gap 108 where it is ready for operation. The direct support of rail tensioning unit 86 on welding head 86 makes it possible to proceed rapidly since the welding head and rail tensioning unit will be automatically centered at the same time. The wide base support leg 96 of suspension yokes 89, 90 assure an unhindered pivoting of double levers 92.

Flash-butt welding machine 111 shown in FIG. 10 similarly comprises machine frame 113 carrying a longitudinally displaceable operator's cab 112 at the front end thereof. The machine frame is supported by undercarriage 115 driven by motor 114 on a track consisting of rails 116 fastened to ties 117. Power driven vertically adjustable and laterally pivotal cantilever crane 118 is mounted at one end of the machine frame and flash-butt welding head 119 is suspended from the crane. Ring-shaped rail tensioning unit 121 includes operating cylinders 102, and both ends of the unit are supported by rollers 122 for running on rail 116 while lower holding members 131 (see FIG. 11) of the pairs of rail clamping jaw means of unit 121 are detached. In addition, apparatus 121 comprises manually-operated pushing rod 123 for moving the apparatus along the rail so that it may be moved under suspended welding head 119 along the one rail. This also makes rail tensioning apparatus 121 operable independently of the welding head.

As shown in the fragmentary detailed view of FIG. 11, rollers 122 are double-flanged wheels respectively mounted on holder 124 welded to upper holding member 126 between two transversely aligned plug-in bolts 125. A respective double lever 127 is pivoted to each plug-in bolt 125 and each double lever carries a rail clamping jaw 128 and an intermediate clamping member 129 for engaging the rail web. Bolts 125 extend through registering bores in upper holding member 126 and double levers 127, the lower ends of the bolts projecting just below the double levers. A pin-and-bore connection 130, 132 between the lower bolt ends and lower holding member 131 is shown to consist of axial bore 130 in the lower bolt end and pin 132 affixed to the lower holding member, pin 132 being inserted in connection bore 130. Detachable splint pin retaining means 134 is arranged between each double lever and the lower holding member. Furthermore, plug-in bolts 135 link double levers 127 to extension member 137 equipped with electrical insulation layer 136, the extension member being connected to operating cylinder 120. This structure enables the rail tensioning unit to be moved along the rail into its operating position without the plug.in bolts contacting the ties. The detached lower holding members are mounted only shortly before the start of the operation to reinforce the transverse connection between the double levers of each pair, and this may be done simply by plugging pins 132 into connection bores 130.

The rail tensioning apparatus may be rolled manually along the rail without having to be dismantled between successive operations. It may be pushed from rail joint to rail joint in advance of the welding machine to reduce the gaps at the joints before the rail section ends are welded together. Double-flanged wheels 122 support apparatus 121 on rail 116 while lower holding members 131 (shown in chain-dotted lines) are dismounted and splint pin retaining means 134 are inserted in plug-in bolts 125 to hold double levers 127 in position. After welding head 119 has been freely suspended on crane 118 centered above gap 138, rail tensioning apparatus 121 is manually pushed under the welding head by rod 123. Lower holding members 131 are then attached and retained in position by splint pins 134. The welding head is then lowered and the combined operation of the rail tensioning apparatus and welding head are then programmed in the manner described hereinabove. The independent mobility of the rail tensioning apparatus enables it to be advantageously used in preparation for the subsequent welding work, for instance by reducing gaps between the rail section ends formed by the removal of thermite welds, for which purpose a manually operated hydraulic fluid pump is used to operate cylinders 131 of the rail tensioning unit.

In the embodiment illustrated in FIGS. 12 to 15, double-flanged wheels 144 support rail tensioning apparatus 139 at each longitudinal end for running on rail 142 while the lower holding members of the pairs of rail clamping jaw means are detached. Bearing blocks 141 vertically adjustably mount the double-flanged supporting wheels on upper holding members 140. The vertically adjustable mounting of the support wheels makes it possible readily and simply to change the rail tensioning apparatus between its operating position and its rest position wherein the apparatus may be moved from one operating site to another. When the apparatus is raised, the lower ends of the plug-in bolts are lifted from an operating position wherein they project between the ties to a rest position wherein they extend above the ties so that the apparatus may be longitudinally displaced.

Double levers 145 constituting rail clamping jaw means 146 are positioned at respective longitudinal ends of rail tensioning apparatus 139 and each double lever is pivoted to upper holding member 140 by plug-in bolt 147. The double levers of each pair of rail clamping jaw means are respectively linked by further plug-in bolts 148 to intermediate extension members 150 equipped with electrical insulation layer 149 and operating cylinders 151. Push rod 152 is connected to one of the upper holding members 140. Splint or cotter pin 153 secures each plug-in bolt 147 in position immediately below respective double lever 145 and the lower ends of these plug-in bolts have bores 154 for insertion of a further retaining pin.

As shown in FIG. 13, rail tensioning apparatus 139 comprises transversely extending support arm 157 detachably connected to one end of the apparatus and roller 156, which also is a double-flanged wheel, is affixed to the support arm for supporting the apparatus on the other track rail. This three-point support assures a stable positioning of the rail tension apparatus on the track while assuring its movability along the track. The two double-flanged support wheels at the longitudinal ends of the apparatus always center the relatively heavy apparatus on the rail which is being tensioned.

Operating cylinders 151 of hydraulic cylinder-piston devices 158 have inlets and outlets 159 for attachment of hydraulic fluid hoses 160 which may be connected to a manually operated hydraulic fluid delivery pump 161 (shown in chain-dotted lines) or to the hydraulic fluid supply system of a mobile flash-butt welding machine. Each double lever 145 consists of a short and a long lever arm 162, 163 forming a step therebetween. Each short lever arm 163 constitutes rail clamping jaw 164 carrying intermediate clamping member 165 for engagement with the rail web. Each upper holding member 140 has a bore 166 in the range of bearing block 141 to receive a respective wheel 144. Bearing block 141 is constituted by two U-shaped holding elements 167 which are transversely spaced from each other and whose lower ends are welded to upper holding member 140. A plug-in bolt 169 is inserted through registering bores in the two U-shaped holding elements and two guide parts 168 which are vertically adjustably held in the holding elements. As shown in FIG. 14, the two guide parts 168 are interconnected by rotary bolt 170 supporting double-flanged wheels 144. Plug-in bolt 169 is retained in position by split or cotter pin 171.

Schematic FIG. 15 shows flash-butt welding machine 172 propelled along the track by motor 173 and carrying hydraulic fluid pump system 174 and electrical current generator 175. A vertically and transversely adjustable jib crane 177 is mounted at one end of the machine and flash-butt welding head 178 is carried by the crane for welding together the rail section ends at gap 179. The welding head is encompassed by ring-shaped rail tensioning apparatus 139 supported on the track by double-flanged wheels 144 and 156. Preceding the machine at a farther distance therefrom is another rail tensioning apparatus 139.

Push rod 152 enables the rail tensioning apparatus to be readily displaced along the track while it is securely supported thereon. Such displacement is effected after vertically adjustable wheels 144 are lowered and the apparatus is correspondingly raised so that the lower ends of plug-in bolts 147 are positioned above the track ties. This is done by briefly raising rail tensioning apparatus 139 at one end by vertically adjusting wheel 144 at that end in bearing block 141 until it is possible to insert plug-in bolts 169 through holding elements 167 and guide parts 168. The same is then done at the other end of the apparatus. In this raised position shown in FIG. 12, the apparatus may be displaced longitudinally along the track. Instead of raising the apparatus, it would also be possible to obtain this result by tilting it about wheel 144 adjacent push rod 152, as shown in chain-dotted lines in FIG. 12, which would also lift the lower ends of bolts 147 above the ties. Either raising of the rail tensioning apparatus can be done only after double levers 145 have been pivoted by cylinders 151 outwardly in the direction of small arrows 180 shown in FIG. 13. The pivoting stroke of the double levers in the direction of arrows 180 must be sufficient to move the pairs of clamping jaws 164 and associated intermediate clamping members 165 so far apart that their spacing is greater than the width of the rail head.

In operation, rail tensioning apparatus 139 adjacent welding machine 172 is pushed by rod 152 below outrigger crane 177 on which welding head 178 is freely suspended. The welding head is then lowered into its operating position at gap 179 where it is encompassed by the ring-shaped rail tensioning apparatus. After retaining pins 171 have been removed, bolt 169 is removed from bearing block 141, whereupon apparatus 139 is lowered into its operating position shown in chain-dotted lines in FIG. 12 until clamping jaws 164 are flush with the rail web. Lower holding members 181 are then pushed onto the lower ends of plug-in bolts 147 projecting between two successive ties 143 and are secured in position by retaining pins inserted through bores 154. Flexible hoses 160 are then connected so that operating cylinders 151 may be actuated by the hydraulic fluid supply pump carried by the welding machine. Welding is now initiated by control 182 and this welding is synchronized with the tensioning of the rail section whose fastening to the ties has previously been loosened. After the welding process has been completed, outrigger crane 177 lifts welding head 178 and lower holding members 181 of the rail clamping jaw means are removed. The two support wheels 144 are then lowered again and they are secured in their lowered position by plug-in bolts 169, whereupon rail tensioning apparatus 139 is ready to be pushed by rod 152 to next gap 179.

At the same time and ahead this operation, another like rail tensioning apparatus 139 is used to reduce the larger gaps between adjoining rail section ends caused, for example, by the removal of old thermite rail joints. The operating cylinders 151 of this apparatus may be actuated by a manually operated hydraulic fluid pump. As indicated in chain-dotted lines in FIG. 15, it is easy to transfer apparatus 139 from one rail to the opposite rail by simply lifting the apparatus manually and carrying to the other rail. Beforehand, support arm 157 is detached and connected to opposite plug connection 155.

What is claimed is:

1. An apparatus for tensioning or longitudinally sliding a rail of a laid track consisting of two rails fastened to ties by fastening elements to reduce a gap between adjacent ends of longitudinally successive rail sections to be welded together to form the rail, the fastening elements of the longitudinally successive rail sections having been loosened, which comprises a closed, ring-shaped mechanical structural unit including (a) two longitudinally spaced pairs of rail clamping jaw means and (b) two transversely spaced hydraulic cylinder-piston devices for operating the rail clamping jaw means, each device connecting respective rail clamping jaw means or said pairs, combined with (c) an electrically operated flash butt welding head received in a central space within the ring-shaped mechanical structural unit, (1) the pairs of rail clamping jaw means being spaced longitudinally and the cylinder-piston devices being spaced transversely to define said central space within the ring-shaped mechanical structural unit for receiving a flash-butt welding head, and (d) an electrical insulation between the longitudinally spaced pairs of rail clamping jaw means at each side of the rail for interrupting any flow of electrical current between the pairs of rail clamping jaw means.

2. The apparatus of claim 1, wherein a respective one of the hydraulic cylinder-piston devices is arranged on each side of the rail, the flash-butt welding head comprises two halves longitudinally adjustable with respect to each other, and the central space, measured in a horizontal plane passing through the rail, has a width and length at a maximum longitudinal spacing of the pairs of rail clamping jaw means in a rail clamping position respectively larger than the width and the length of the cross section of the maximally adjusted welding head halves.

3. The apparatus of claim 2, wherein the width and length of the central space are about 10–15% larger than the width and length of the cross section of the maximally adjusted welding head halves.

4. The apparatus of claim 1, wherein each pair of rail clamping jaw means comprises (a) two double levers arranged mirror-symmetrically with respect to a vertical plane passing through the rail, each double lever consisting of (1) a short lever arm and a superposed long lever arm, the short and long lever arms defining a step therebetween, and (2) the short lever arm constituting a rail clamping jaw, (b) two detachable holding members spanning the rail respectively thereabove and therebelow and arranged to connect and to hold the double levers therebetween, and (c) a respective pivot pivotally connecting each double lever to the holding members at each side of the rail, the long lever arms of one of the pairs of rail clamping jaw means being linked directly to the cylinders of the cylinder-piston devices, and the structural unit further comprising an intermediate extension member linking the long lever arms of the other pair of rail clamping jaw means to the pistons of the cylinder-piston devices.

5. The apparatus of claim 4, wherein the electrical insulation is arranged between two coaxial interconnected parts of the intermediate extension member.

6. The apparatus of claim 4, wherein a lower one of the holding members has spacing elements attached thereto, the spacing elements extending between the double levers and the lower holding member.

7. The apparatus of claim 4, wherein the pivots are detachable plug-in bolts.

8. The apparatus of claim 7, further comprising a detachable retaining means at the lower ends of the bolts.

9. The apparatus of claim 8, wherein the retaining means is a splint pin means inserted in the lower ends of the bolts below the lower holding member for rapid detachment and retention of the bolt.

10. The apparatus of claim 8, further comprising another detachable retaining means between the double levers and the lower holding member.

11. The apparatus of claim 7, wherein the bolts extend through registering bores in an upper one of the holding members and the double levers, lower ends of the bolts projecting just below the double levers, and further comprising a pin-and-bore connection between the lower bolt ends and a lower one of the holding members, and a detachable retaining means retaining the pin in the bore of the connection.

12. The apparatus of claim 11, wherein the lower bolt ends define the bore of the connection and the lower holding member has the pin inserted into the connection bore, the detachable retaining means being a splint pin means arranged between the double levers and the lower holding member.

13. The apparatus of claim 4, wherein the rail has a rail head, a rail base and a web interconnecting the rail head and base, the long lever arms extend in a horizontal plane in the range of the rail head and have an upper side extending thereabove, and the short lever arms extend in a horizontal plane in the range of the rail web and have an underside extending above the rail base.

14. The apparatus of claim 13, wherein the short lever arms have about half the length of the long lever arms.

15. The apparatus of claim 4, wherein the axes of the cylinders and the intermediate extension members linked to the long arms are arranged just above a horizontal plane defined by an upper side of the rail head.

16. The apparatus of claim 4, further comprising rollers supporting the apparatus for running on the rail while lower ones of the holding members of the pairs of rail clamping jaw means are detached.

17. The apparatus of claim 16, wherein the rollers are mounted on upper ones of the holding members of the pairs of rail clamping jaw means.

18. The apparatus of claim 17, further comprising bearing blocks vertically adjustably mounting the rollers on the upper holding members at respective longitudinal ends of the apparatus.

19. The apparatus of claim 18, further comprising a transversely extending support arm detachably connected to one end of the apparatus and a roller affixed to the support arm for supporting the apparatus on the other track rail.

20. The apparatus of claim 1, further comprising a hydraulic fluid supply pump means and flexible hydraulic fluid hoses connecting the pump means respectively to inlets and outlets in the cylinders of the cylinder-piston devices for operating the rail clamping jaw means.

21. The apparatus of claim 20, further comprising a control for operating the welding head, and means for synchronizing the operation of the rail clamping jaw means and of the welding head for simultaneously reducing the gap between the adjacent rail section ends and for welding the adjacent rail section ends together.

22. The apparatus of claim 1, further comprising a pushing rod attached to the apparatus for moving the apparatus along the rail.

23. The apparatus of claim 1, further comprising a mobile rail welding machine supported on the track rails by longitudinally spaced undercarriages, the rail welding machine including a bridge-like machine frame, wherein the flash-butt welding head and the ring-shaped structural unit are longitudinally, transversely and vertically adjustably arranged between two of the longitudinally spaced undercarriages, the machine frame having a transverse guide pivotally supporting a telescopingly extensible, power-operated support arm, and a suspension means suspending the unit from the support arm.

24. The apparatus of claim 23, wherein the mobile welding machine includes a trailer supported on one of the undercarriages and the bridge-like machine frame part extends between the machine and the trailer.

25. The apparatus of claim 1, further comprising a mobile rail welding machine supported on the track rails, a cantilever crane longitudinally, transversely and vertically adjustably mounting the flash-butt welding head on one end of the machine for placing the welding head within the central space, and a suspension yoke means supporting the structural unit to center the welding head between the cylinder-piston devices.

26. The apparatus of claim 1, further comprising a mobile rail welding machine supported on the track rails, a cantilever crane longitudinally, transversely and vertically adjustably mounting the flash-butt welding head on one end of the machine for placing the welding head within the central space, the structural unit being supported for mobility on the rail.

* * * * *